US008447063B2

(12) United States Patent
Chu

(10) Patent No.: US 8,447,063 B2
(45) Date of Patent: May 21, 2013

(54) FLAT THIN DYNAMIC SPEAKER

(76) Inventor: Walter Ka Wai Chu, Tai Wai (HK)

( * ) Notice: Subject to any disclaimer, the term of this patent is extended or adjusted under 35 U.S.C. 154(b) by 177 days.

(21) Appl. No.: 12/931,284

(22) Filed: Jan. 29, 2011

(65) Prior Publication Data

US 2011/0188697 A1 Aug. 4, 2011

Related U.S. Application Data

(60) Provisional application No. 61/299,937, filed on Jan. 30, 2010.

(51) Int. Cl.
*H04R 25/00* (2006.01)

(52) U.S. Cl.
USPC ..... 381/396; 381/423; 381/431

(58) Field of Classification Search
USPC ..... 381/396, 397, 398, 399, 403, 404, 381/405, 407, 408, 409, 412, 423, 431, 433; 181/171, 172
See application file for complete search history.

(56) References Cited

U.S. PATENT DOCUMENTS 5,664,024 A * 9/1997 Furuta et al. ..... 381/412
6,594,372 B2 * 7/2003 Nakaso ..... 381/396

* cited by examiner

*Primary Examiner* — Huyen D Le
(74) *Attorney, Agent, or Firm* — Raymond Y. Chan; David and Raymond Patent Firm

(57) ABSTRACT

A flat thin dynamic speaker which includes a motor unit, a suspension unit, a radiating unit and a frame arranged in such a manner that the motor unit and the suspension unit are at the same plane while the radiating unit is on top of the motor unit such that the thickness of the speaker assembly is reduced while the performance of the speaker assembly is maintained or even improved. Also, the speaker can be made into a quadrangular, polygon or a spherical structure. The speaker further has a surround at a level lower than the radiating unit without utilizing the radiating surface of the radiating unit such as a maximized radiating surface is provided, and includes a dual side voice-coil actuation to the radiator unit, thereby providing a slim and flat speaker assembly with high power output.

17 Claims, 12 Drawing Sheets

FLAT THIN DYNAMIC SPEAKER

CROSS REFERENCE OF RELATED APPLICATION

This is a non-provisional application that claims the benefit of priority under 35 U.S.C. §119 to a provisional application, application No. 61/299,937, filed Jan. 30, 2010.

BACKGROUND OF THE PRESENT INVENTION

1. Field of Invention

The present invention relates to a flat thin dynamic speaker, and more particularly to a flat thin dynamic speaker with a novel arrangement of components that yields a large radiating surface area and high output levels compared to conventional dynamic speakers of the same thickness and footprint by having the magnetic circuit at the same level as the suspension means.

2. Description of Related Arts

For many products containing speakers such as flat screen television receivers, cell phones, and portable computers, it is desirable to use speakers as flat and thin as possible and often in shapes other than round or ellipse so as not to limit the designer's options for the design and appearance of the products.

The major elements of a conventional dynamic speaker are schematically illustrated in FIG. 1. This type of speaker consists of four major components: a frame 4', upon which the structure rests; a radiating means 1', such as a piece of paper or plastic, or a metal cone or dome which couples with the speaker to a transmission medium such as air or water; a flexible suspension means 2' to mechanically attaching the radiating means and any other moving parts to the frame 4' in such a way as to allow motion of the radiating means 1 in one axis while constraining motion in the other two axes and at the same time providing a restoring force along the Z-axis, and a driving means 3', or motor, which provides a force to move the radiating means 1' in response to a driving voltage, which is analogous to the desired acoustic output of the speaker assembly.

The physical size and mass of each of the components are usually optimized for particular applications, such as those used to reproduce particular ranges of frequencies and power (sound pressure) levels, or to couple to various acoustic transmission media such as air and water. The physical size of the components necessary for a particular application constrains the range of sizes of the speaker assembly, and the conventional arrangement of components makes it difficult to design well performing speakers in shapes other than ellipses and circles.

The conventional approach to making speaker thinner is schematically illustrated in FIG. 2 and graphically illustrated in FIG. 3A to 3C. In this case, the flexible suspension means 2' is incorporated into the periphery of the radiating surface 1'. This approach allows for a lower profile, but it has several disadvantages that hurt performance.

For good performance, the radiating surface 1' needs to be relatively stiff, yet the portion of the radiating surface 1' that acts as the flexible suspension means 2' needs to be flexible. A common means of mitigating the desultory effects of these conflicting requirements is to compromise the stiffness of the material and to corrugate the region that acts as the flexible suspension means. This allows the designer of the speaker to make tradeoffs among the stiffness of the radiating means, the flexibility of the flexible suspension means, the thickness of the speaker and performance.

The conventional thin speaker approach also trades away some of the available surface area available for a given size radiating means to radiate power to make room for the flexible suspension means and also reduces the total available displacement along the Z-axis for lacking additional suspension.

Reducing the total available displacement along the Z-axis results in a lower maximum power output for a given radiating means 1' surface area. The reduced surface area available further reduces the maximum achievable acoustical output power.

The conventional thin speaker approach trades away performance to reduce thickness and is unsatisfactory.

SUMMARY OF THE PRESENT INVENTION

The invention is advantageous in that it provides a novel configuration of the four major components of a speaker assembly such that the thickness of the speaker assembly is reduced while the performance of the speaker assembly is maintained or even improved.

Another advantage of the present invention is to provide a slim speaker assembly which comprises a frame, a motor, a suspension means and a radiating means arranged in such a manner that the overall thickness of the speaker assembly is not increased by the suspension means, the optimized construction of the radiating means is not limited by the suspension means, and the radiating area of the radiating means is not reduced by the provision of surround, thereby a slim and flat speaker assembly with high output is realized.

Another advantage of the present invention is to provide a speaker assembly in which the materials limitation for the suspension means and the radiating means is eliminated.

Another advantage of the present invention is to provide a slim and quadrangular speaker assembly which is capable of a high quality of sound effect comparable to or better than that of a conventional eclipse or spherical shaped speaker.

Another advantage of the present invention is to provide a speaker assembly in which the surface area of the radiating means is maximized, independent on the size of the suspension means and the surround.

Another advantage of the present invention is to provide a speaker assembly in which the surface area of the radiating means is optimized, independent on the materials of the suspension means.

Another advantage of the present invention is to provide speaker assembly with a dual side voice-coil actuation to the radiation means.

Another advantage of the invention is to provide a speaker assembly with surround made by bent or corrugated straight sheets or foils by metals or hard plastic.

Additional advantages and features of the invention will become apparent from the description which follows, and may be realized by means of the instrumentalities and combinations particular point out in the appended claims.

According to the present invention, the foregoing and other objects and advantages are attained by a flat thin dynamic speaker assembly, comprising:

a motor unit provided on an outer periphery of said speaker assembly, setting a height of said motor unit and defining an inner enclosed portion, wherein said motor unit comprises a magnetic yoke having a magnetic yoke cavity and defining an inner surface, at least one magnet affixed to said magnetic yoke inside said magnetic yoke cavity through said inner surface of said magnetic yoke, and a voice coil suspendedly provided inside said magnetic yoke cavity;

a suspension unit provided in said inner enclosed portion of said motor unit and mounted to said motor unit in such a manner that said suspension unit and said motor unit are in the same plane and said suspension unit, wherein said suspension unit has a height smaller than the height of said motor unit such that said suspension unit is capable of completely received within said inner enclosed portion of said motor unit without increasing a height of said speaker assembly;

a lead out wire connected to said suspension unit arranged for connecting to a power source;

a post having a first and a second end portions, connected to said suspension unit through said first portion;

a radiating unit having a height and defining a radiating surface, suspendedly supported by said post through said second end portion of said post in such a manner that the radiating surface of said radiating unit is capable of being extended to reach said outer periphery of said speaker assembly and is capable of moving upwardly and downwardly along its vertical axis; and a bobblin unit affixed to said radiating unit in such a manner that said bobbin unit is extended toward said magnetic yoke cavity to provide a mounting surface for mounting said voice coil, thereby said suspension unit is indirectly coupled to said voice coil such that vertical movement of said voice coil is stabilized while horizontal displacement and angular rotation of said voice coil is suppressed.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Referring to FIGS. 4 to 23, a speaker assembly according to a preferred embodiment of the present invention is illustrated.

Figure 1:
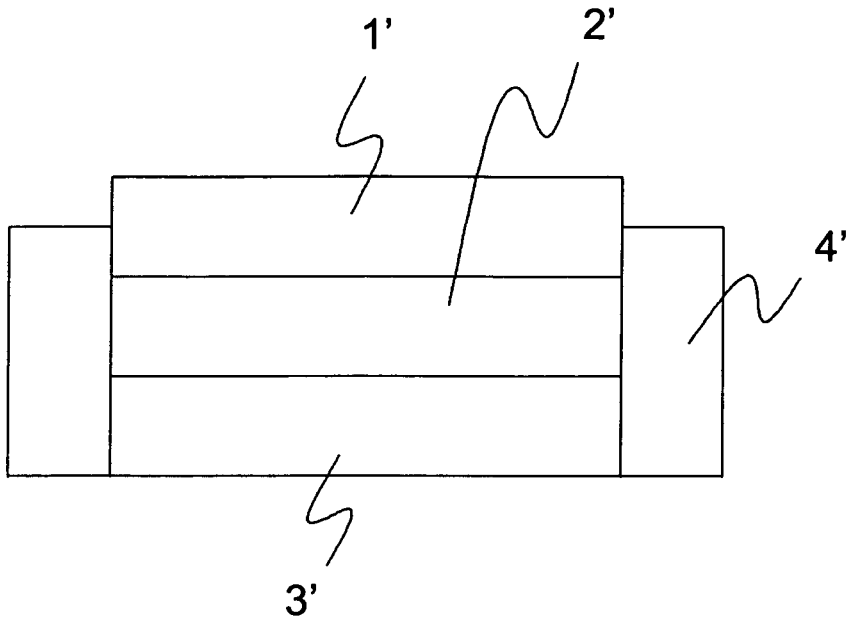
FIG. 1 PRIOR ART
FIG. 1 is a schematic illustration of a conventional dynamic speaker.
Figure 2:
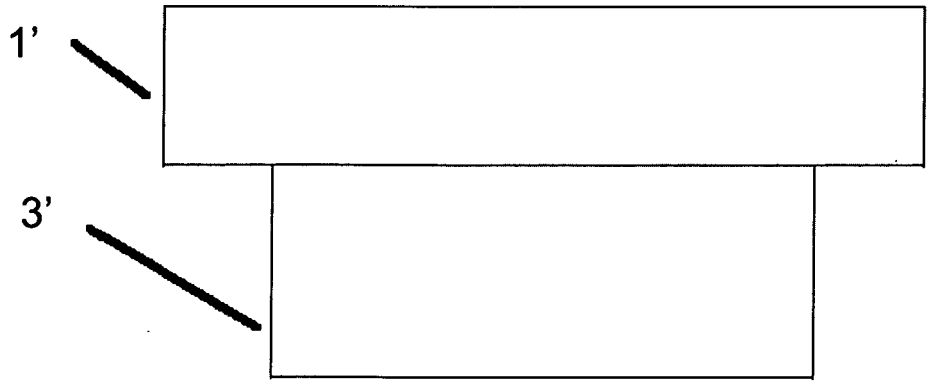
FIG. 2 PRIOR ART
FIG. 2 is a schematic illustration of another conventional dynamic speaker.
Figure 3A:
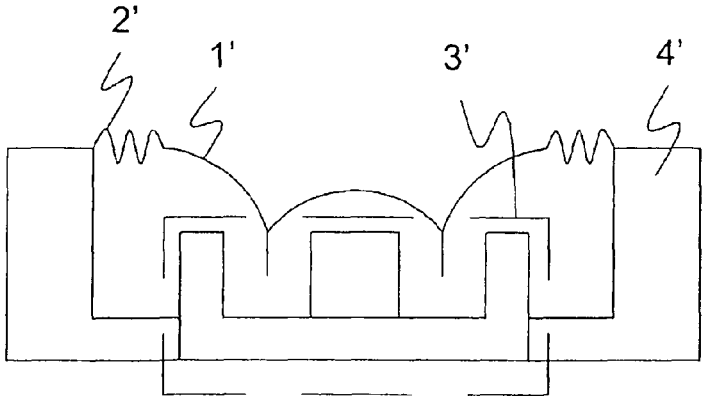
FIG. 3A PRIOR ART
FIG. 3A-3C are schematic illustrations of conventional dynamic speakers.
Figure 3B:
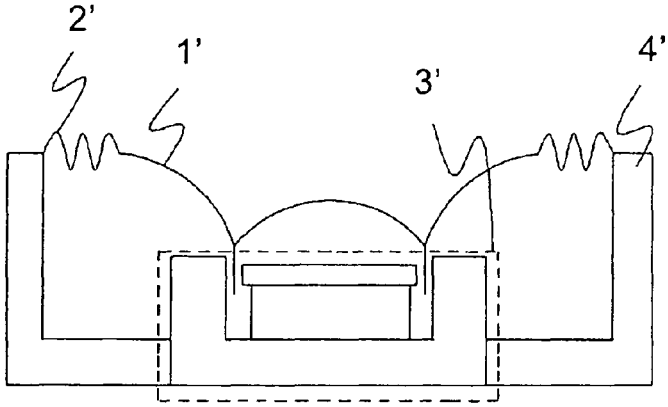
FIG. 3B PRIOR ART
Figure 3C:
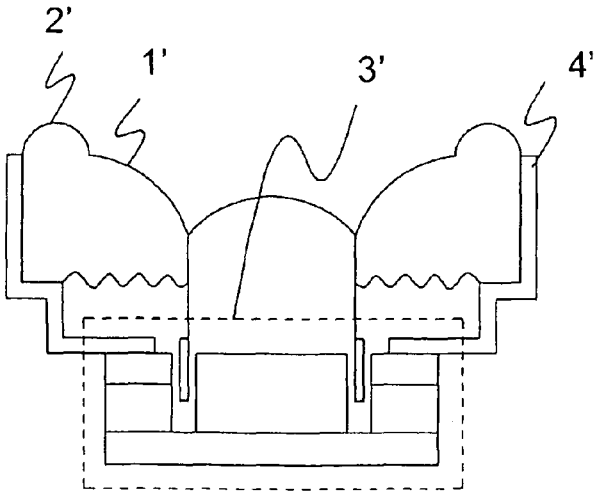
FIG. 3C PRIOR ART
Figure 4:
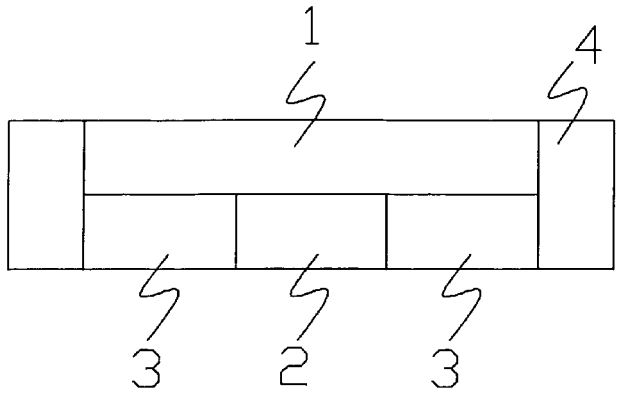
FIG. 4 is a schematic illustration of a speaker assembly according to a preferred embodiment of the present invention.

Referring to FIG. 4, which is a schematic representation of the preferred embodiment of the present invention, the motor 3 is positioned at the periphery of the speaker assembly, making it possible for the flexible suspension means 2 to be mounted in the same plane as the motor, thus reducing the minimum achievable height of the stack of components needed for a given application and level of performance.

Figure 5:
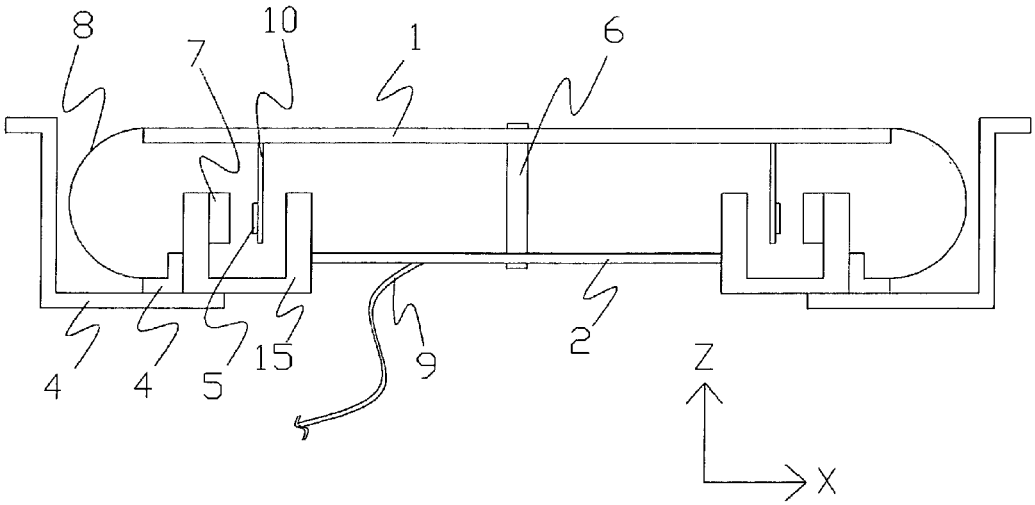
FIG. 5 is a cross-section schematic illustration of the speaker assembly according to the above preferred embodiment of the present invention.

FIG. 5 shows a cross-section of the simplified example. The thin flat speaker may be of many different sizes and shapes in the X-Y plane, such as eclipse, rectangle, triangular, and square, as long as the shape allows the general arrangement of components shown in FIG. 5.

It can be seen from FIG. 5 that the radiating means 1, which is a radiating unit, is mounted to the magnetic yoke 15 by means of a rigid connecting posts 6 and a flexible suspension means 2, resulting in the suspension means 2 being indirectly coupled to the voice coil 5, which stabilizes the voice coil's 5 Z-axis motion and suppresses the movement in the X-Y plan including displacement and angular rotation.

The flexible suspension means 2 is often referred to as a "spring", "damper" or "spider". In the case of the present invention, the term refers to an element that provides elastic support along the Z-axis as defined in FIG. 5, namely a suspension unit 2. In some embodiments, it may be a simple piece of material that has the required mechanical characteristics and in other embodiments it may be a piece of material within which a pattern is cut to enhance its mechanical performance, or onto which a component with appropriate mechanical characteristics is mounted.

A surround 8 serves to block sound pressure waves under the back of radiating means 1 from radiating to the front and therefore canceling some frequencies in the transmission medium. In other words, the surround 8 serves to avoid the cancellation during transmission.

The radiating means 1 can be made of a light weight rigid or semi-rigid material, such as copper clad fiberglass boards used in printed circuit board manufacturing.

Voice coils 5 is mounted on the bobbin assemblies 10 (the bobbin unit), which is firmly affixed to the radiating means 1. Magnets 7 are firmly affixed to magnetic yoke 15. The combination of voice coil 5, magnetic yoke 15 and magnets 7 comprise the motor 3.

In operation, the mechanical force generated by the interaction between the current of the voice coil 5 and the magnetic flux from the permanent magnets 7 causes the radiating surface 1 to be displaced along the vertical axis, which is related to the function of the current through the voice coil 5, the strength of the permanent magnet 7, the geometry of the magnets 7 and the magnetic circuit provided by the magnetic yoke 15, and the force of the flexible suspension means 2. When current is reduced or removed, the radiating surface returns to its resting position.

Lead out wires 9 provides a means of electrical connection to the voice coils.

This arrangement, in which the motor 3, the radiating means 1, flexible support 2, and the frame 4 are at the same level along the Z axis rather than stacked vertically allows for large travel in the Z axis for a given height along the Z axis, while still constraining motion in the X and Y axes as with conventional speaker designs. Large maximum travel in the Z axis allows higher maximum sound pressure output for a given radiating means 1 surface area. Minimizing motion in the X and Y axes minimizes some types of distortion.

Since the surround 8 can be located below the radiating means 1 instead of on the same plane as radiating means 1 as occurs in conventional designs, the surface area of the radiating means 1 is maximized and this, along with the increased maximum travel along the Z axis and the higher actuating force available from the motor 3 due to its elongated structure allows for a greater output power, which is greater output surround level, for a given footprint.

Figure 6A:
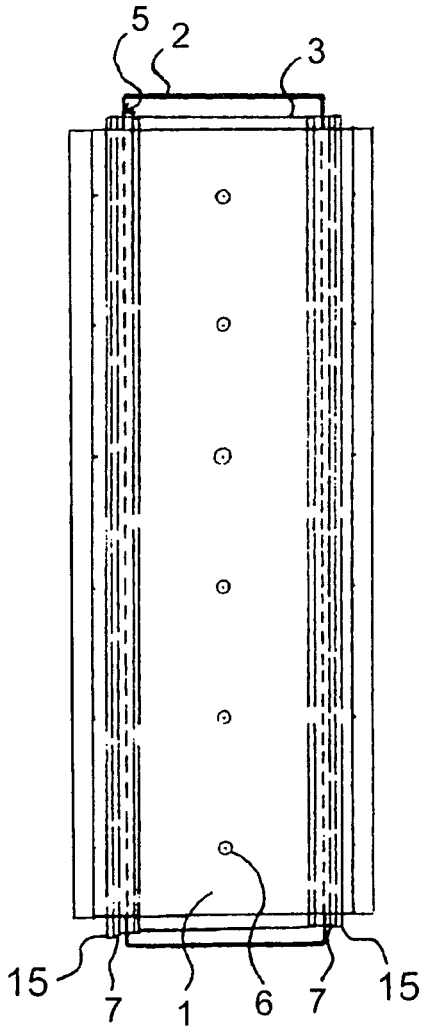
FIG. 6A is a schematic illustration of the speaker assembly according to the above preferred embodiment of the present invention.
Figure 6B:
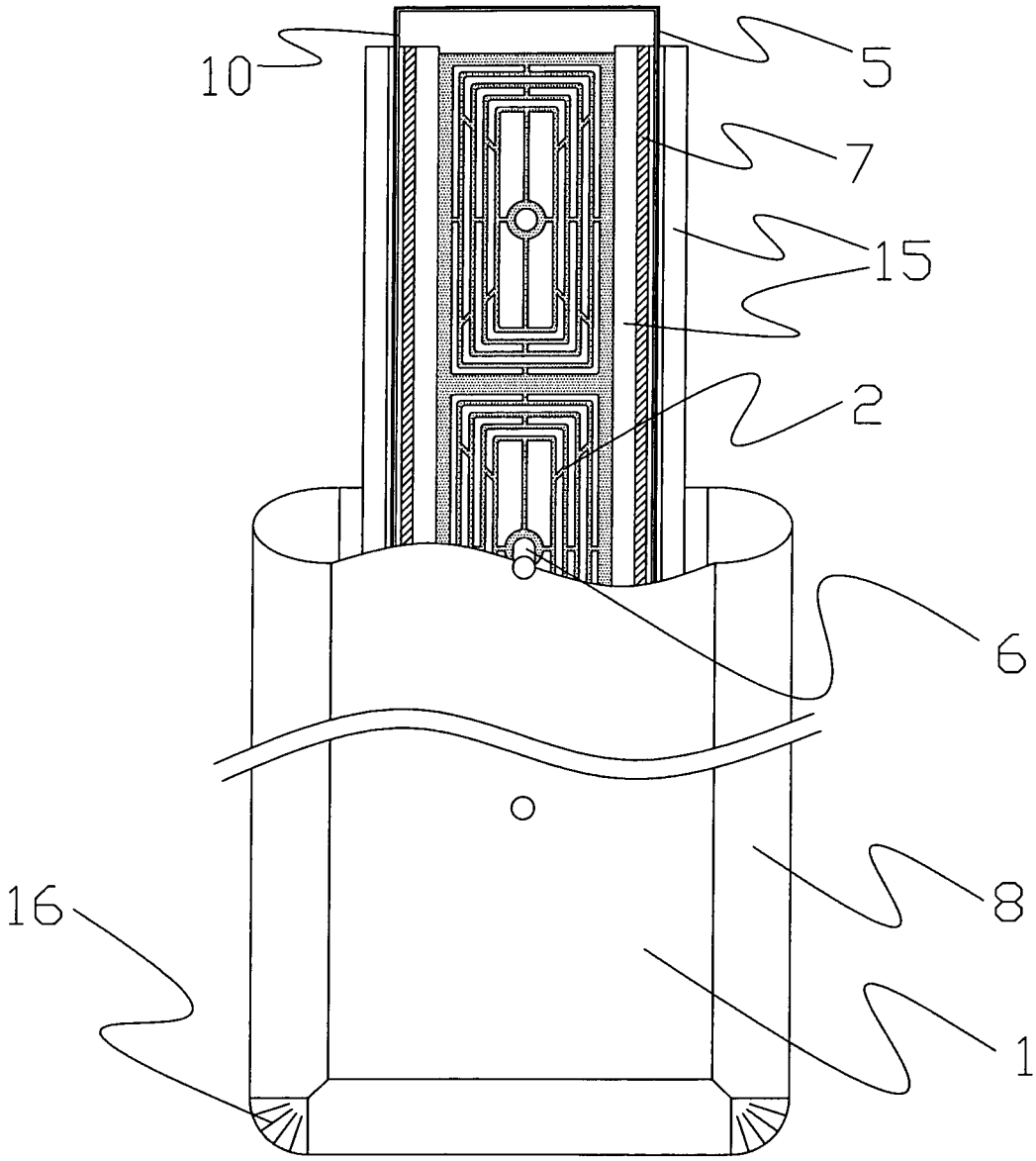
FIG. 6B is a front sectional schematic illustration of the speaker assembly according to the above preferred embodiment of the present invention.

The preferred embodiment is a long, narrow, thin speaker assembly, the top view of which is depicted in FIGS. 6A and 6B. The dimensions are fifteen inches along the Y axis, two inches along the X axis and three-quarters of an inch along the Z axis, making it suitable for use in a flat panel display or flat panel television receiver. With a 15:2 length (Y axis) to width (X axis) ratio, six rigid connecting posts 6 are used between the radiating means 1 and the flexible suspension means 2 are employed in order to minimize motion in the X and Y axes and to better distribute the damped restoring forces of the flexible suspension means 2.

The radiating means 1 can be fabricated from a variety of materials, and may include copper clad fiberglass such as used in printed circuit board construction, polymers, composites, honeycombed materials, wood, and stiff paper. In the preferred embodiment radiating means 1 is approximately 0.5 millimeter thick copper-clad fiberglass laminate, such as those commonly used as the substrate of printed circuit boards, with the copper removed selectively on the bottom side of the radiating means 1 in a pattern that is used as the conductor paths between the voice coil 5 and the lead out wires 9, and other possible functions, like soldering an accelerometer sensor IC for measurement and feedback controls.

The voice coil 5 is wound as a continuous multiple turn solenoid, held in place by the bobbin assembly 10 composed of several turns of a conductor. The number of turns (together with the gauge of the magnet wire) is a function of the target speaker nominal impedance and input power handling capability. The insulated conductor can be one of a variety of shapes and materials for both the conductor and the insulation, if used, including round and flat wire, a ribbon, a polymer film lamination, or a printed pattern on a printed circuit board, in the preferred embodiment voice coil 5 made by winding 14 turns of AWG 27 copperclad aluminum wire with polyimide film insulation, one example of this kind of wire is the CCA10 family, manufactured by Elektrisola, Inc, in Boscawen. N.H.

The bobbin assembly 10 can be made in such a way as to omit the bobbin itself, such as by shape-forming from self-bonded magnet wire, moulding the conductor in a plastic or epoxy compound or impregnating with a varnish, and mounting the molded or impregnated part directly to the radiating means 1. The bobbin part of the bobbin assembly can be made with metal foil, polymer film, but in the preferred embodiment the bobbin part of the bobbin assembly is made of approximately 0.35 millimeter thick copper-clad fiberglass laminate, such as those commonly used as the substrate of printed circuit boards.

Figure 7:
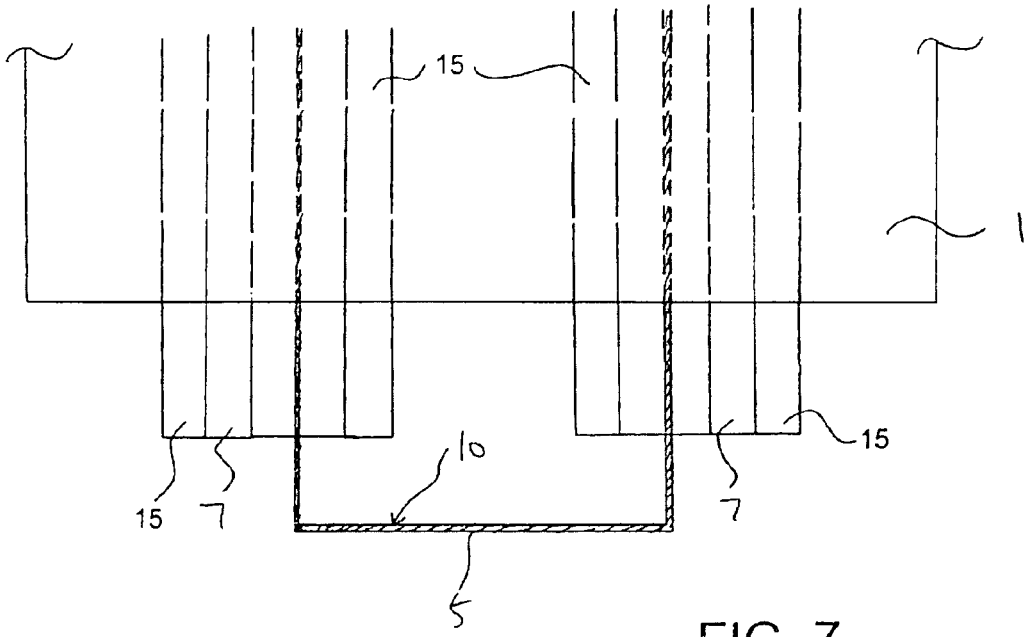
FIG. 7 is a perspective sectional schematic illustration of the speaker assembly according to the above preferred embodiment of the present invention.

A magnified view of the bottom of the top view shown in FIG. 6A is shown in FIG. 7.

Figure 8:
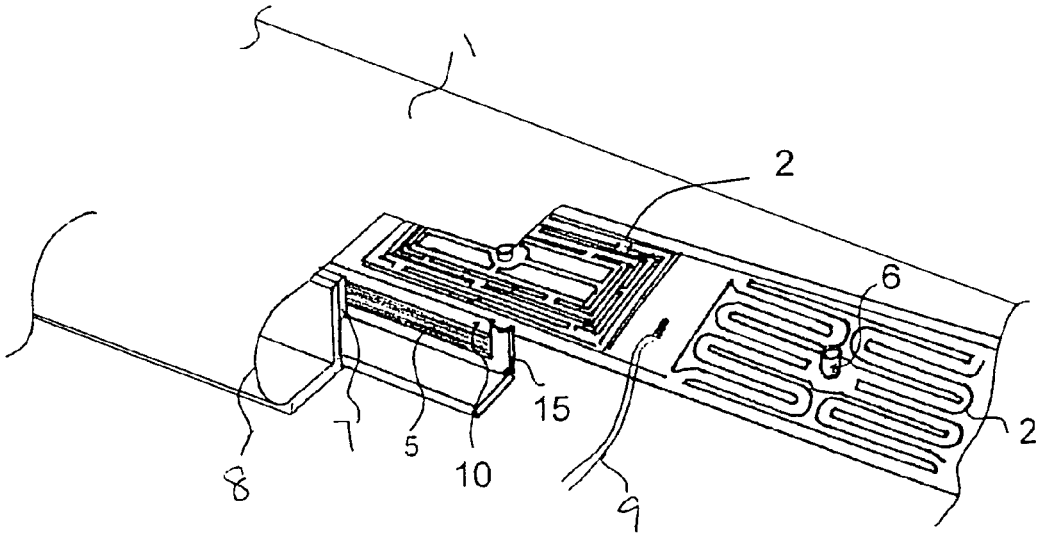
FIG. 8 is an enlarged view of a portion of the schematic illustration of the speaker assembly of FIG. 6A according to the above preferred embodiment of the present invention.

The cut-away isometric view of FIG. 8 shows another view of the preferred embodiment.

There are many possible ways to construct the flexible suspension means 2. In the preferred embodiment. The flexible suspension means 2 is part of a long narrow piece of copper-clad fiberglass laminate, such as those commonly used as the substrate of printed circuit boards. The board has a slightly smaller area than the radiating means 1, and the spring-like patterns of flexible suspensions means 2 are created by routing, punching, or laser cutting. In the preferred embodiment the spring-like patterns of flexible suspensions means 2 are created by punching.

Figure 16:
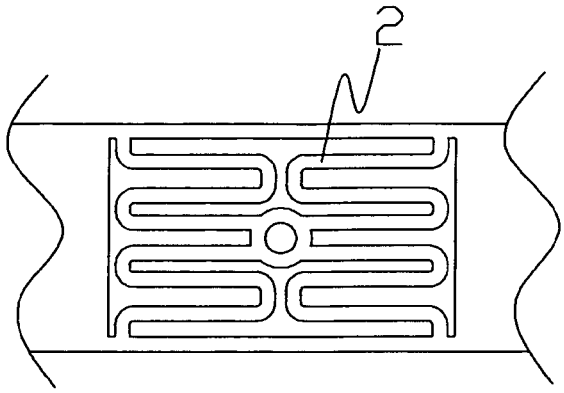
FIG. 16 is an exemplary illustration of a suspension means of the speaker assembly according to the above preferred embodiment of the present invention.
Figure 17:
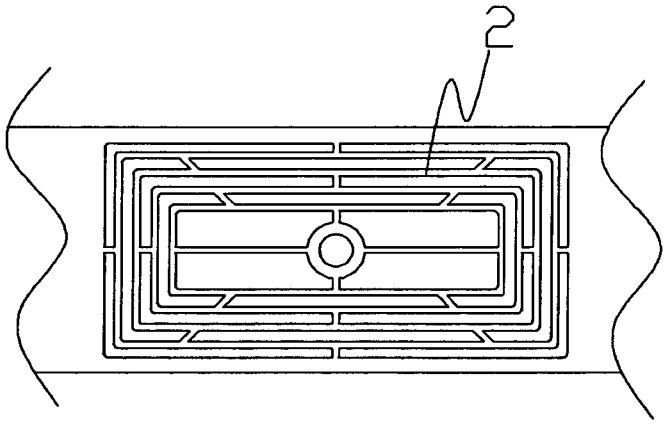
FIG. 17 is another exemplary illustration of a suspension means of the speaker assembly according to the above preferred embodiment of the present invention.
Figure 18:
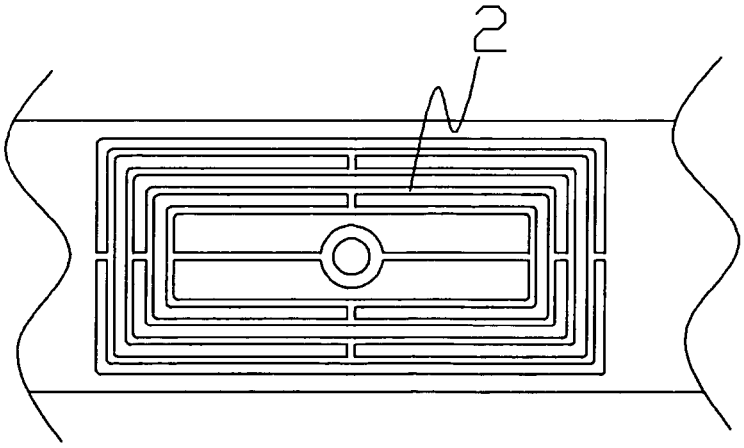
FIG. 18 is another exemplary illustration of a suspension means of the speaker assembly according to the above preferred embodiment of the present invention.

The pattern of the flexible suspension means 2 is tuned for each design, taking into account such variables as the dimensions of and the materials used in the components of the speaker. Examples of some possible are shown in FIG. 16, FIG. 17, and FIG. 18.

Alternatively, other methods and materials can be used to form the flexible suspension means 1, such as by etching Beryllium Copper, or stamped steel as long as the resulting flexible suspension means 1 has the proper restoring force and is properly damped.

The flexible suspension means 2 can also be any of the traditional suspension means, such as the traditional "spider" made of corrugated cloth.

An advantage of using copper laminated fiberglass boards for the construction of the flexible suspension means 2 is that the copper can be etched and printed circuits, such as to create the conducting path from the rigid connecting post 6 to the lead out wire 9. Electronic circuits such as crossover networks, protection circuits, non-volatile memory, amplifier, signal processor etc. can also be accommodated on the same substrate.

Depending upon application requirements, speakers can have one or more sets of flexible suspension means 2. The preferred embodiment has two sets of springs. The lower flexible suspension means 2 connects to the frame 4 and to the lower rigid connecting posts 6, which in turn connects to the upper flexible suspension means 2 which in turn connects to the radiating means 1. The use of more than one flexible suspension means 2 is that the resistance to tilting in the Z axis is increased and greater restoring force can be realized for a given flexible suspension means design.

In the preferred embodiment, there are two sets of flexible suspension means with spring-like patterns similar to that shown in FIG. 17 disposed along the Z axis of the speaker. The spring-like patterns are made of approximately 0.35 millimeter thick copper-clad fiberglass laminate, such as those commonly used as the substrate of printed circuit boards.

The rigid connecting posts 6 that join the radiating means 1 to the flexible suspension means 2 can be made of many different materials and shapes. Examples are solid , hollow or filled materials with circular, cylindrical, square or hexagonal cross-sections, in the form of solid rods or wires, hollow metal tubes, insulating materials with or without conductive surfaces or embedded conductors, and made of materials such as copper or its alloys; copper-clad aluminum, copper clad plastics, or composite materials such as carbon fiber reinforced plastics. The rigid connection posts 6 can also be molded as a feature on the radiating means 1.

In the preferred embodiment, the rigid connecting rods 6 are made of thin walled brass tubing.

Lead out wires 9 provides a means of electrical connection to the voice coils 5.

The lead out wires 9 can also be connected directly to voice coil 5 and in that case may be made using tinsel wire.

In the preferred embodiment, the wires from voice coil 5 are individually soldered to two electrically insulated copper patterns on radiating means 1. The two electrically isolated copper patterns on radiating means 1 connect by means of soldering to two conducting electrically insulated rigid connecting posts 6, which are preferably made of thin walled brass tubing so they may be soldered to directly. The two electrically insulated rigid connecting posts 6 are soldered to two electrically insulated spring-like patterns on flexible suspension means 2. Two flexible copper wires, which form the lead out wires 9 are individually soldered to the two electrically insulated spring-like patterns on the stationary parts of the flexible suspension means 2. Near the solder joint, the lead out wires 9 are glued to the flexible suspension means 2 near the spring-like patterns with epoxy to provide some strain relief. Lead out wires 9 are further attached to the frame 4 with epoxy.

Figure 9:
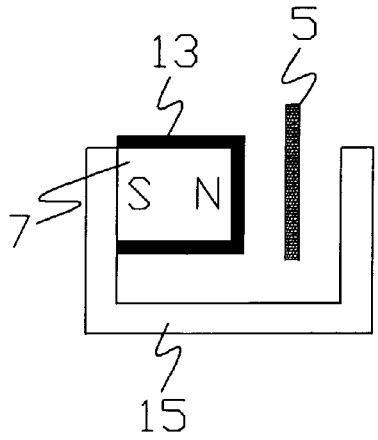
FIG. 9 illustrates an exemplary configuration of magnetic circuit of the speaker assembly according to the above preferred embodiment of the present invention.
Figure 10:
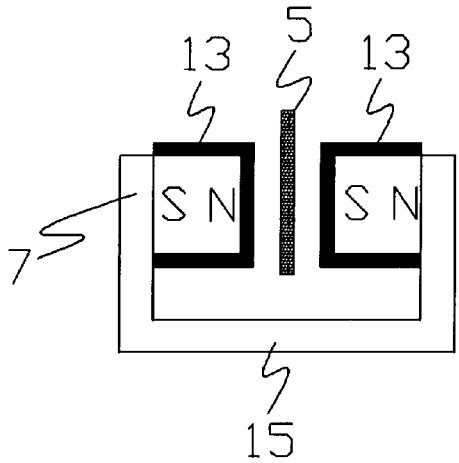
FIG. 10 illustrates another exemplary configuration of magnetic circuit of the speaker assembly according to the above preferred embodiment of the present invention.
Figure 11:
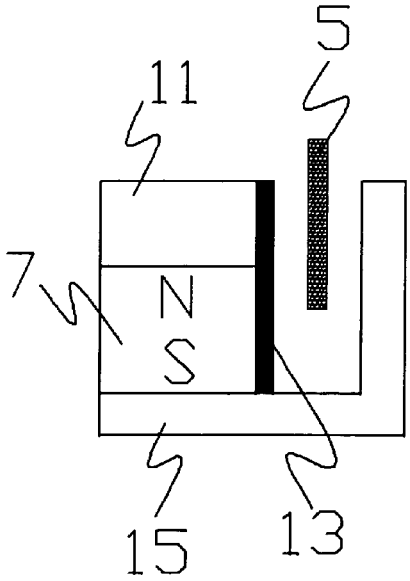
FIG. 11 illustrates another exemplary configuration of magnetic circuit of the speaker assembly according to the above preferred embodiment of the present invention.
Figure 12:
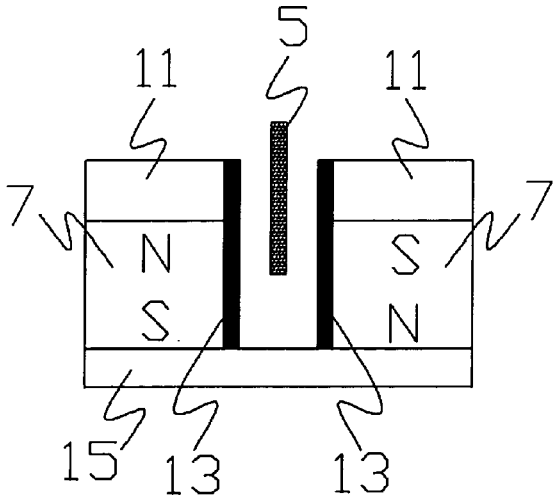
FIG. 12 illustrates another exemplary configuration of magnetic circuit of the speaker assembly according to the above preferred embodiment of the present invention.
Figure 13:
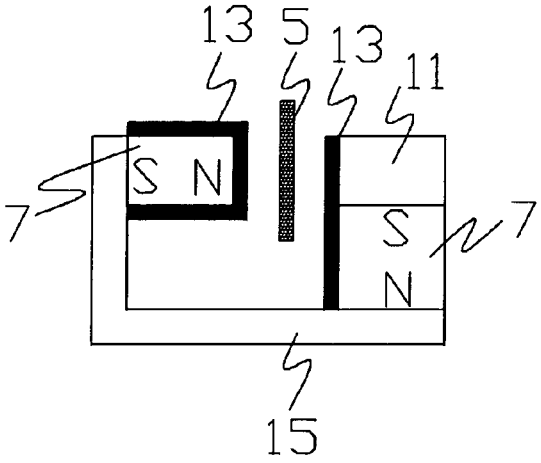
FIG. 13 illustrates another exemplary configuration of magnetic circuit of the speaker assembly according to the above preferred embodiment of the present invention.

This invention lends itself to the use of a variety of magnetic circuits, as shown in FIGS. 9 to 13. The simplest configuration is shown in FIG. 9. For increased power, particularly in larger speakers two permanent magnets 7, one disposed on either side of the voice coil 5, can be employed as shown in FIG. 10. Some of the other possible configurations are noted in FIGS. 11, 12, and 13.

In the preferred embodiment the magnetic arrangement of FIG. 10 is preferred to be used.

Figure 14A:
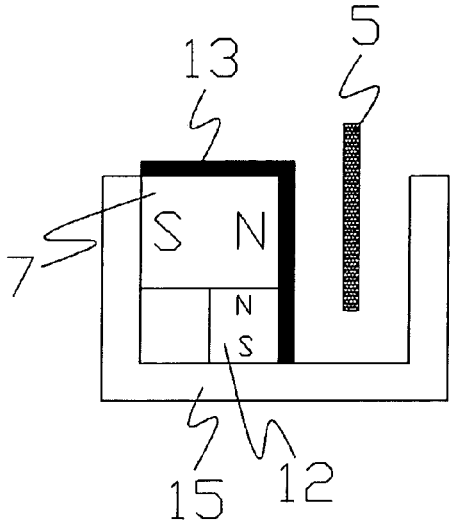
FIG. 14A illustrates another exemplary configuration of magnetic circuit of the speaker assembly according to the above preferred embodiment of the present invention.
Figure 14B:
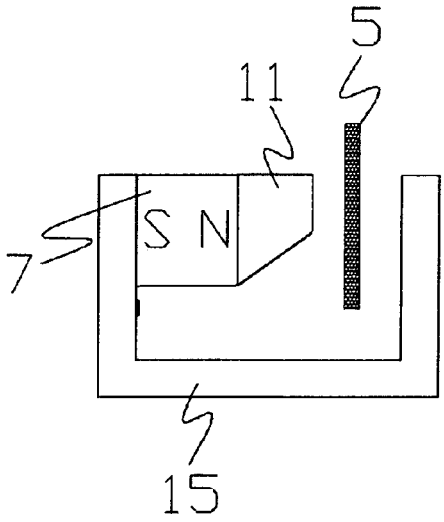
FIG. 14B illustrates another exemplary configuration of magnetic circuit of the speaker assembly according to the above preferred embodiment of the present invention.

Referring to FIGS. 14A and 14B of the drawings, a magnetic flux focusing unit 11 (12) may be used to concentrate the flux in a preset position. For example, a magnetic flux focusing magnet 12 can be added to concentrate the flux in the gap between the permanent magnet 7 and magnetic yoke 15 as shown in FIG. 14A. Or a magnetic flux focusing iron 11 can be added to concentrate the flux and shorten the magnetic gap height as shown in FIG. 14B.

The power dissipated in voice coil 5 of larger speakers can be high enough to cause concern that the temperatures may rise to the point at which the permanent magnets 7 can loose their magnetization. To improve the speaker's ability to handle higher power without damage to the magnets, a thin heat conducting means 13 can optionally be disposed between the voice coil 5 and the permanent magnet 7. Some examples of the shapes that the heat conducting means 13 can take are shown in FIG. 14.

The heat conducting means 13 can be made of any non-magnetic material that has good thermal conductivity. Examples of such materials are copper, aluminum and graphite.

Figure 15:
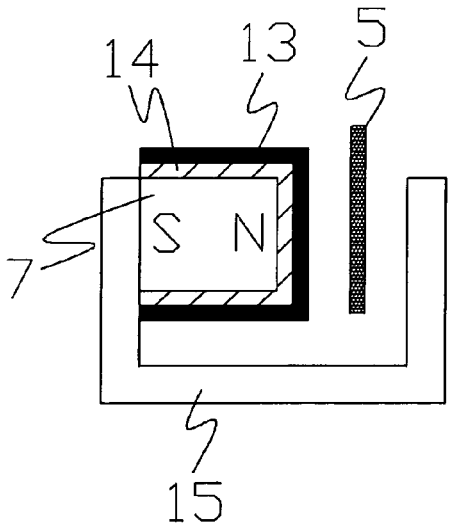
FIG. 15 illustrates another exemplary configuration of magnetic circuit of the speaker assembly according to the above preferred embodiment of the present invention.

In some cases, the permanent magnet 7 can be protected from heat generated by the voice coil 5 by a thermal barrier 14. Thermal barrier 14 can be made of one of many suitable insulating materials, such as paper, adhesive transfer film, double-sided adhesive tape, foam, fiberglass, wood, or air. The thermal barrier 14 can be used alone or disposed between the permanent magnet 7 and heat conduction means 13, as shown in FIG. 15.

In the preferred embodiment, a heat conducting means 13 is made of thin copper foil and thermal barrier 14, which is adhesive transfer film such as RD-577 Silicone Adhesive Transfer Tape from PPI Adhesive products Limited in Waterford, Ireland.

Figure 19A:
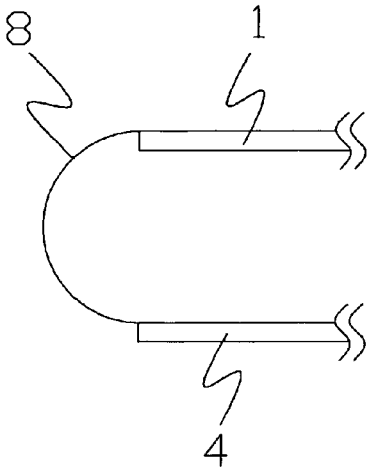
FIG. 19A is an exemplary illustration of a surround of the speaker assembly according to the above preferred embodiment of the present invention.
Figure 20A:
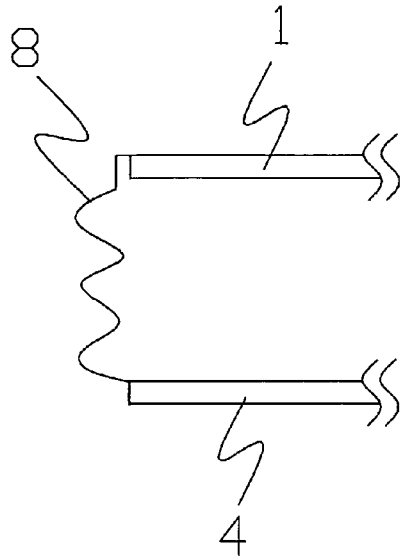
FIG. 20A is another exemplary illustration of a surround of the speaker assembly according to the above preferred embodiment of the present invention.
Figure 19B:
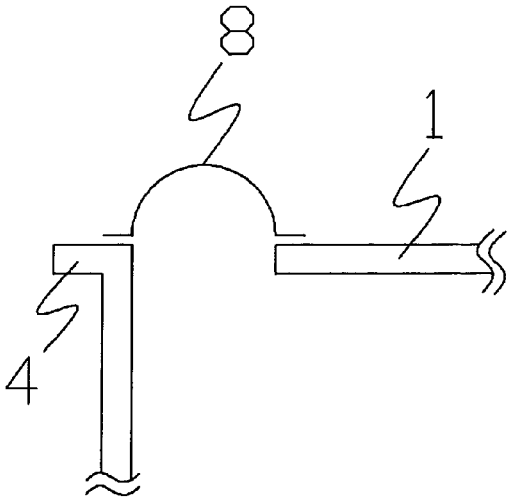
FIG. 19B is another exemplary illustration of a surround of the speaker assembly according to the above preferred embodiment of the present invention.
Figure 20B:
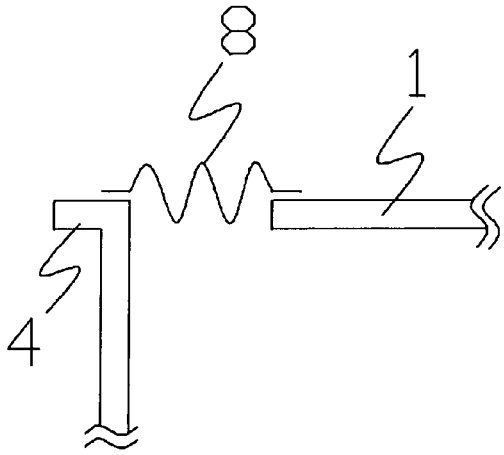
FIG. 20B is another exemplary illustration of a surround of the speaker assembly according to the above preferred embodiment of the present invention.

Referring to FIGS. 19A to 20B, the surround 8 is preferably flexible and may be in many shapes but is preferably a round (curved) shape, bending inward or outward, and may contain features such as corrugation patterns to improve its flexibility and therefore the linearity of the speaker. Two of the many possible patterns are shown in FIG. 19A and FIG. 20A. The material used to make surround 8 can be any material that provides suitable flexibility and resistance to wear and fatigue. Suitable materials include paper, cloth, polymer or elastomer foams; sheets of rubber, santoprene, polyurethane or silicone; perforated materials such as bronze, beryllium copper, stainless steel, titanium, and copper foils; or plastic films like polycarbonate, PET, PEN, and the like.

Though the purpose of surround 8 serves to block sound pressure waves under the back of radiating means 1 from radiating to the front and therefore canceling some frequencies in the transmission medium, it may also act as spring to provide restoring force, similar to that of flexible suspension means 2.

In some larger speakers, acceptable performance can be obtained without the surround.

In the preferred embodiment, the surround 8 is preferably made of beryllium copper foil in a curved shape bending outward.

The Surround 8 can be attached to either surface of the radiating means 1 or the frame 4. The four corner openings of the surround 8 can be sealed by adhering relatively softer materials like corrugated polymer films like PET film, or mold-shaped rubber, rubber foam, or other polymers and their foams.

Figure 22:
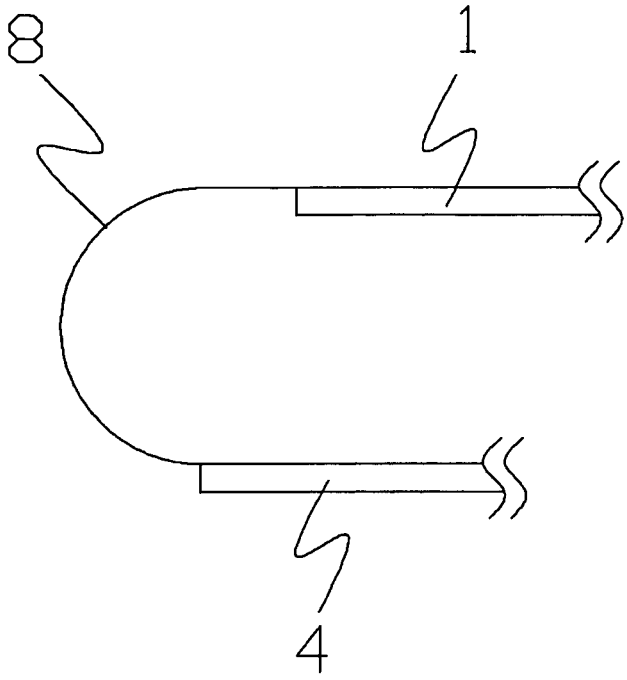
FIG. 22 is an exemplary illustration of an asymmetric surround of the speaker assembly according to the above preferred embodiment of the present invention.
Figure 23:
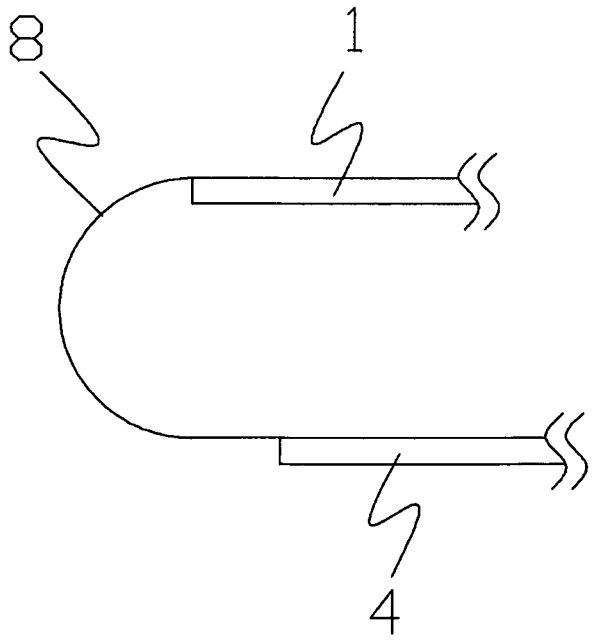
FIG. 23 is another exemplary illustration of an asymmetric surround of the speaker assembly according to the above preferred embodiment of the present invention.

For some designs, the edges of frame 4 and radiating means 1 may be of greatly different areas or offset from one another to accommodate specific design requirements, and in such cases the surround 8 may be asymmetric along the Z axis, as show in FIG. 22 and FIG. 23.

Also, speaker surround constructions like curved upward or down can also be employed.

The components of which the speaker is made may be adhered to the radiating means 1 and the frame 4 by any of several techniques, such as the use of adhesives, soldering, riveting, and welding.

In the preferred embodiment, frame 4 is soldered to magnetic yoke 15 which hold the permanent magnets 7, the permanent magnets 7 are held to magnetic yoke 15 with epoxy, and heat conducting means 13 is fastened to the magnet by thermal barrier 14, which is made of Silicone Adhesive Transfer Tape. Magnetic yoke 15 is soldered to flexible support means 2. Flexible support means 2 is soldered to Rigid connecting posts 6. Rigid connecting posts 6 is soldered to radiating means 1. Radiating means 1 is soldered to bobbin assembly 10. Voice coil 5 is wound upon and glued to bobbin assembly 10.

From the foregoing, it will be appreciated by those skilled in the art that the invention is applicable to many different types of products ranging from larger products such as television receivers and larger to much smaller products such as cell phones, wrist watches, and smaller, and can be scaled and optimized for each application. Furthermore, while a preferred embodiment of the invention has been shown and described, it will be apparent to those skilled in the art that changes can be made in the embodiment without departing from the principles and spirit of the invention disclosed above.

Figure 21:
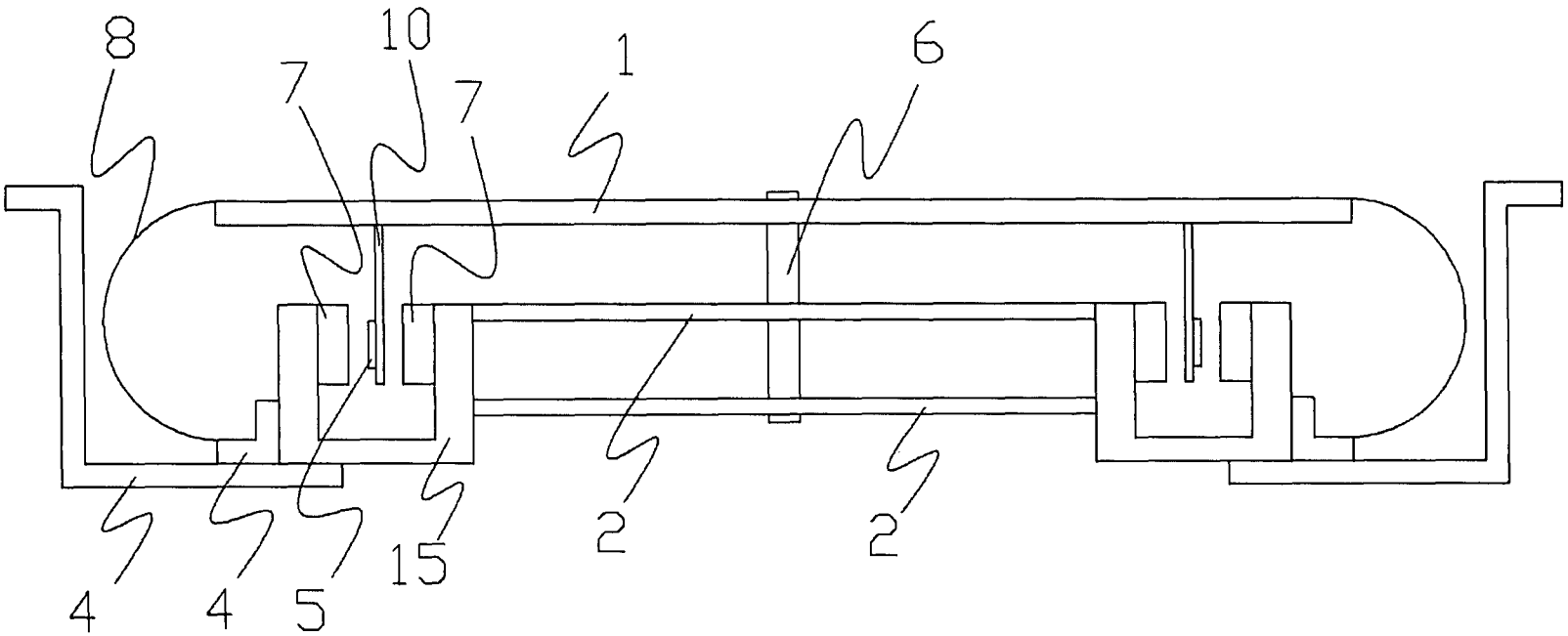
FIG. 21 is a cross-section schematic illustration of an alternative of the speaker assembly according to the above preferred embodiment of the present invention.

For example, as shown in FIG. 21 of the drawings, the speaker assembly includes two magnet 7 for each of the bobbin assembly 10 and two suspension means spacedly and layeredly positioned.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A speaker assembly, comprising:

a radiating unit having a radiating surface;

a motor unit arranged at a peripheral position of said radiating unit, wherein said motor unit is provided on an outer periphery of said speaker assembly, setting a height of said motor unit and defining an inner enclosed portion, wherein said motor unit comprises a magnetic yoke having a magnetic yoke cavity and defining an inner surface, at least one magnet affixed to said magnetic yoke inside said magnetic yoke cavity through said inner surface of said magnetic yoke, and a voice coil suspendedly provided inside said magnetic yoke cavity;

a suspension unit is provided between said radiating unit and said motor unit, at a position in said inner enclosed portion of said motor unit and mounted to said motor unit in such a manner that said suspension unit and said motor unit are in the same plane and said suspension unit, wherein said suspension unit has a height smaller than the height of said motor unit such that said suspension unit is capable of completely received within said inner enclosed portion of said motor unit without increasing a height of said speaker assembly; and a lead out wire connected to said suspension unit arranged for connecting to a power source and at least a post having a first and a second end portions, connected to said suspension unit through said first portion.

2. The speaker assembly, as recited in claim 1, wherein said radiating unit has a height and defining a radiating surface, suspendedly supported by said post through said second end portion of said post in such a manner that the radiating surface of said radiating unit is capable of being extended to reach said outer periphery of said speaker assembly and is capable of moving upwardly and downwardly along its vertical axis.

3. The speaker assembly, as recited in claim 2, further comprising a bobblin unit affixed to said radiating unit in such a manner that said bobbin unit is extended toward said magnetic yoke cavity to provide a mounting surface for mounting said voice coil, thereby said suspension unit is indirectly coupled to said voice coil such that vertical movement of said voice coil is stabilized while horizontal displacement and angular rotation of said voice coil is suppressed.

4. The speaker assembly, as recited in claim 3, further comprising a frame connected to said motor unit in a peripheral manner supporting and framing said motor unit, wherein a height of said speaker assembly is defined by the height of said motor unit and the height of said radiating such that the height of said speaker assembly is minimized.

5. The speaker assembly, as recited in claim 4, wherein said frame defines a connecting portion mounting to said motor unit, wherein said speaker assembly further comprises a surround mounting between said motor unit through said connecting portion and said radiating unit through an outer peripheral portion of said radiating unit such that sound cancellation is minimized.

6. The speaker assembly, as recited in claim 5, wherein said surround is mounted to said outer peripheral portion of said radiating unit at a level below said radiating unit such that said radiating surface is maximized for providing a greater output surround level.

7. The speaker assembly, as recited in claim 5, wherein said radiating unit is elongated and sheet in structure defining an X-axis and an Y-axis for said radiating unit, and has a thickness which is the height of said radiating unit defining a Z-axis, wherein said radiating unit is linked to said motor unit through said post and said suspension unit such that said radiating area is capable of being maximized for increasing a travel distance along the Z axis and reaching a higher actuating force from said motor unit while minimizing motion in the X and Y axes.

8. The speaker assembly, as recited in claim 7, wherein said motor further comprise a magnetic flux focusing unit supported through said magnetic yoke so as to concentrate the magnetic flux generated through the motor unit at a preset position.

9. The speaker assembly, as recited in claim 7, further comprising a heat conducting unit disposed between said voice coil and said magnet so as to protect said magnet against damage when a temperature of said voice coil is sufficiently high to cause damage to said magnet.

10. The speaker assembly, as recited in claim 7, further comprising a thermal barrier enclosing an exposed surface area of said magnet serving as a heat insulator for protecting said magnet against damage when a temperature of said voice coil is sufficiently high to cause damage to said magnet.

11. The speaker assembly, as recited in claim 5, wherein said suspension unit has a preset pattern and a center portion connecting to said post in such a manner that said post is transversely extended from said center portion of said suspension unit towards said radiating unit.

12. The speaker assembly, as recited in claim 11, wherein said preset pattern of said suspension unit is a spring pattern created.

13. The speaker assembly, as recited in claim 11, further comprising at least one additional suspension unit supported through said post and said frame unit such that a multi-layered suspension unit structure is formed for increasing a restoring force for said suspension unit.

14. The speaker assembly, as recited in claim 11, wherein said voice coil comprises a plurality of wires which are individually soldered to two electrically insulted copper patterns on said radiating unit.

15. The speaker assembly, as recited in claim 3, wherein said suspension unit is made of flexible material and said radiating unit is made of rigid or semi-rigid material.

16. The speaker assembly, as recited in claim 3, wherein said suspension unit is copper laminated fiberglass board comprising at least one etched and printed circuit such that a conducting path between said lead out wire and said post is defined.

17. The speaker assembly, as recited in claim 3, wherein said motor provided on the outer periphery of said speaker assembly is a symmetrical structure which is capable of providing a dual side voice-coil actuation to said radiator unit on two sides.

* * * * *